US005172163A

United States Patent [19]

Yamaoki et al.

[11] Patent Number: 5,172,163

[45] Date of Patent: Dec. 15, 1992

[54] PHOTOVOLTAIC PHOTO-RECEPTOR AND ELECTROPHOTOGRAPHING APPARATUS

[75] Inventors: Toshihiko Yamaoki; Tomonori Nagashima; Koji Minami, all of Osaka, Japan

[73] Assignee: Sanyo Electric Co., Ltd., Osaka, Japan

[21] Appl. No.: 521,708

[22] Filed: May 9, 1990

[30] Foreign Application Priority Data

May 10, 1989 [JP] Japan ..... 1-117066
Jun. 27, 1989 [JP] Japan ..... 1-164141

[51] Int. Cl.[5] ..... G03G 15/00

[52] U.S. Cl. ..... 355/210; 355/211; 430/31; 430/58

[58] Field of Search ..... 355/210, 211; 430/31, 430/58, 95, 84; 346/153.1; 250/370.01; 357/7, 17, 20

[56] References Cited

U.S. PATENT DOCUMENTS 4,330,182 5/1982 Coleman ..... 352/2
4,514,744 4/1985 Saitoh et al. ..... 346/153.1
4,757,332 7/1988 Yuasa ..... 346/160
4,820,846 4/1989 Brown et al. ..... 548/420
4,841,328 6/1989 Takeuchi et al. ..... 355/211
4,873,436 10/1989 Kamieniecki et al. ..... 250/315.3
4,875,101 10/1989 Endo et al. ..... 358/213.19

*Primary Examiner*—A. T. Grimley
*Assistant Examiner*—T. A. Dang
*Attorney, Agent, or Firm*—Darby & Darby

[57] ABSTRACT

A photovoltaic photo-receptor includes a glass substrate, a transparent electrode, a plurality of photovoltaic layers which are sequentially laminated and formed and mainly composed of a-Si having photovoltaic functions, and a surface layer formed on the uppermost photovoltaic layer and composed of a-SiN. When a light image is irradiated from an LED array head, photovoltaic voltges are generated on the respective photovoltaic layers in accordance with the light image, whereby an electrostatic latent image having a potential which is established by adding the voltages generated at the respective photovoltaic layers is formed on the surface layer. A toner to which a developing bias is applied is supplied from a magnetic brush to be brought into contact with the surface layer of the photovoltaic photoreceptor, so that the electrostatic latent image is toner-developed. A toner image is transcribed onto a paper by a transcribing roller which is applied with a transferring bias.

33 Claims, 10 Drawing Sheets

PHOTOVOLTAIC PHOTO-RECEPTOR AND ELECTROPHOTOGRAPHING APPARATUS

BACKGROUND OF THE INVENTION

1. Field of the Invention

The present invention relates to a photovoltaic photo-receptor and an electrophotographing apparatus. More specifically, the present invention relates to a novel photovoltaic photo-receptor and an electrophotographing apparatus using the same, in which an electrostatic latent image corresponding to a light image which is irradiated onto a photovoltaic photoreceptor is formed on a surface by means of a photovoltaic function of a semiconductor photovoltaic layer.

2. Description of the Prior Art

An electrophotographing apparatus which utilizes a corona discharge as shown in FIG. 1 is generally well-known. With reference to FIG. 1, in this conventional electrophotographing apparatus, around a photo-receptor 1, a charger 2, a light source 3, a developer 4, a transcriber 6, an eraser lamp 8, a cleaner 9 and etc. are arranged for respectively performing the process such as corona charging, era and etc.

A surface of the photo-receptor 1 being rotated is uniformly charged by the charger 2 and, when a light image is irradiated by the light source 3, an electrostatic latent image is formed on the surface of the photoreceptor 1 in accordance with a photoconductive function. The electrostatic latent image is toner-developed by the developer 4 and a toner image is transcribed onto a paper 5 by the transcriber 6. A transcribed toner image is fixed on the paper 5 by a fixing device 7 and the paper is discharged. The residual static electricity on the surface of the photoreceptor 1 is erased by the eraser lamp 8 and a residual toner on the surface of the photo-receptor 1 is removed by the cleaner 9.

In the electrophotographing apparatus which utilizes the corona discharge as shown in FIG. 1, the charger 2, light source 3, developer 4, transcriber 6, eraser lamp 8, cleaner 9 and etc. must be arranged around the photoreceptor 1, and therefore, there was a disadvantage that the structure thereof becomes complex.

In view of such a problem, recently, an electrophotographing apparatus which does not utilize the corona discharge as shown in FIG. 2 was proposed. With reference to FIG. 2, in this newly proposed electrophotographing apparatus, a developing device 11 is arranged above an outer surface of a photo-receptor 10, a transcribing roller 15 is arranged below the outer surface, and an LED array head 13 is arranged inside the photoreceptor 10. In more detail, the photo-receptor 10 includes a cylindrical transparent substrate 10*a* made of a glass, and a transparent electrode 10*b* and a photoconductive layer 10*c* are sequentially laminated on an outer surface thereof, and a developing bias 12 is applied between the transparent electrode 10*b* and a magnetic roller 11*a* constituting the developing device 11. An electric conductive toner is adhered onto an outer surface of a sleeve 11*b* which covers an outer surface of the magnetic roller 11*b*, whereby a magnetic brush is formed and a tip end of the magnetic brush is brought into contact with an outer surface of the photoconductive layer 10*c*.

A charge is injected from the developing bias 12 to the photoconductive layer 10*c* through the electric conductive toner so that the photoconductive layer 10*c* is charged approximately the same potential as the developing bias 12. On the other hand, a light image projected by the LED array head 13 is irradiated into the photoconductive layer 10*c* from an inside of the cylindrical transparent substrate 10*a*. Therefore, an electrostatic latent image is formed on the photoconductive layer 10*c* in accordance with a photoconductive function thereof, and the electric conductive toner of the magnetic brush is adhered onto the electrostatic latent image so that a toner image is formed on the surface of the photoconductive layer 10*c*. The toner image is transcribed onto a paper 14 by the transcribing roller 15.

A residual toner on the surface of the photo-receptor 10 is removed by a sweeping force of the developing device 11 and a magnetic force of the magnetic roller 11*a*. Therefore, the charging, exposing, developing and cleaning with respect to the photo-receptor 10 are performed at approximately the same time by the developing device 11 and the LED array head 13, and therefore, the structure and the process can be drastically simplified in comparison with a conventional electrophotographing apparatus as shown in FIG. 1.

In the newly proposed electrophotographing apparatus as shown in FIG. 2, as described above, the structure and the electrophotographing process can be largely simplified, while it is difficult to stably obtain a good image quality because the charging is performed by utilizing the developing bias which is applied in developing. More specifically, the developing bias should be set at the most proper value by taking both of a charging characteristic of the toner and a potential of the electrostatic latent image into consideration, but in a case where the developing bias also performs the charging of the photo-receptor 10 as done in FIG. 2 conventional example, a voltage value which is originally necessary for the developing bias and a voltage value which is necessary for charging are necessarily not coincident with each other, and therefore, it is difficult to set a voltage value of the developing bias 12 by which the both can be satisfied at the same time.

SUMMARY OF THE INVENTION

Therefore, a principal object of the present invention is to provide a novel photovoltaic photoreceptor.

Another object of the present invention is to provide a photo-receptor by which a good image quality can be obtained.

Another object of the present invention is to provide a novel photovoltaic photo-receptor, in which an electrostatic latent image according to a light image which is irradiated onto a surface of a photo-receptor is formed by a photovoltaic function of a semiconductor photovoltaic layer.

Another object of the present invention is to provide an electrophotographing apparatus which utilizes a novel photovoltaic photo-receptor.

A photovoltaic photo-receptor in accordance with the present invention comprises: a substrate; and a photovoltaic layer which is formed on the substrate and composed of a semiconductor having a photovoltaic function, said photovoltaic layer forming an electrostatic latent image according to a light image on a surface thereof by a photovoltaic function when the light image is irradiated thereto.

In the present invention, when the light image is irradiated onto the photovoltaic layer, the photovoltaic function serves at a portion of the light image, so that a photo-electromotive force is generated in accordance with the intensity of the light image. A potential is presented on the surface of the photovoltaic layer by the photo-electromotive force according to the light image so as to form the electrostatic latent image.

In one aspect of the present invention, a plurality of photovoltaic layers are formed in a laminated fashion, and an electrostatic latent image having a potential which is established by adding voltages which are generated by respective photovoltaic layers is formed on the outermost surface of the photovoltaic layers. Therefore, by properly setting the number of photovoltaic layers, it is possible to simply obtain an necessary electrostatic latent image potential.

In a case where a plurality of photovoltaic layers are laminated on the substrate, in order to make a photovoltaic efficiency at each of the photovoltaic layers good as much as possible, a thickness and/or an optical energy band of each photovoltaic layer are set in the most properly. Since a lot of light absorption occurs when the thickness of the photovoltaic layer is large, the thickness of the respective photovoltaic layers are set so as to gradually become larger from a side to which the light image is irradiated toward the outermost surface. In addition, when the optical energy band is large, a light having a wavelength that is relatively short is easily absorbed but a light having a wavelength that is relatively long is difficult to be absorbed. Therefore, the optical band gaps of the respective photovoltaic layers are set to gradually become larger from the side to which the light image is irradiated toward the outermost surface. By doing so, the light having a wavelength that is relatively short effectively contributes to the generation of electricity at the side to which the light image is irradiated and the light having a wavelength that is relatively long effectively contributes to the generation of electricity at a side of the outermost surface, whereby a total photovoltaic efficiency becomes large. Therefore, it is possible to ensure a sufficient latent image potential with the lesser number of photovoltaic layers.

In addition, an electrophotographing apparatus in accordance with the present invention comprises: a photovoltaic photo-receptor which includes a substrate and a photovoltaic layer formed on the substrate and composed of a semiconductor having a photovoltaic function, said photovoltaic layer forming an electrostatic latent image on a surface thereof in accordance with a light image by means of a photovoltaic function thereof when the light image is irradiated thereto; light source means for irradiating said light image to the photovoltaic photo-receptor; toner supplying means for supplying a toner to be brought into contact with a surface of the photovoltaic photo-receptor, said toner being adhered on the surface of the photovoltaic photo-receptor due to a potential of the electrostatic latent image so as to form a toner image; and transcribing means for transcribing the toner image formed on the surface of the photovoltaic photo-receptor onto a paper.

In accordance with the present invention, since it is not necessary to provide with a corona discharger, eraser lamp, cleaner and etc. in the electrophotographing apparatus, in comparison with the prior art shown in FIG. 1, the structure and the electrophotographing process become very simple. In addition, the potential of the electrostatic latent image is primarily dependent on a magnitude of a voltage generated at the photovoltaic layer and is not dependent on the developing bias, it is possible to set the developing bias at the most proper voltage value originally required for the developing, and therefore, it is possible to implement a good image quality.

In the present invention, a wavelength of a light outputted from the light source means is set at a wavelength by which the generation of electricity can be performed in the photovoltaic layer most effectively. In addition, if light source means capable of outputting a plurality of kinds of light each having different wavelength at the same time is used, a photovoltaic efficiency at the photovoltaic layer is further improved.

In a case where a plurality of photovoltaic layers are laminated on the substrate, in order to make the photovoltaic efficiency at each of the photovoltaic layers good as much as possible, the thickness and optical energy bands of the respective photoconductive layers are set under the optimum condition. In addition, in this case, if the light source means capable of outputting a plurality kinds of light each having different wavelength at the same time is used, a total photovoltaic efficiency can be further increased because the degrees of light absorption at the respective photovoltaic layers are different from each other. For example, in the case of the same optical energy band, the absorption of a light having a longer wavelength is smaller than the absorption of a light having a shorter wavelength. Therefore, the light having a shorter wavelength effectively contributes to the generation of electricity at a side to which the light image is irradiated and the light having a longer wavelength effectively contributes the generation of electricity at a side of the outermost surface. In addition, in a case of the same wavelength, the larger optical energy band, the smaller light absorption rate. Therefore, by selecting the thickness and/or optical energy bands of the photovoltaic layers or the wavelength of the light from the light source means in accordance with a proper combination thereof, it is possible to further improve an image quality.

In addition, as a photovoltaic layer, it is possible to use not only a normal PIN junction but also a junction of an insulation layer and a semiconductor layer. In this case, an impurity is doped in the insulation layer or the semiconductor layer in accordance with a predetermined impurity atom concentration profile. The impurity atom concentration profile is so set that the concentration is gradually increased from a side of the substrate toward a surface. In accordance with this embodiment, it is possible to make a photovoltaic layer be high resistance, and therefore, it is possible to further increase the resolution of the image.

The objects and other objects, features, aspects and advantages of the present invention will become more apparent from the following detailed description of the embodiments of the present invention when taken in conjunction with accompanying drawings.

DETAILED DESCRIPTION OF THE PREFERRED EMBODIMENTS

Figure 3:
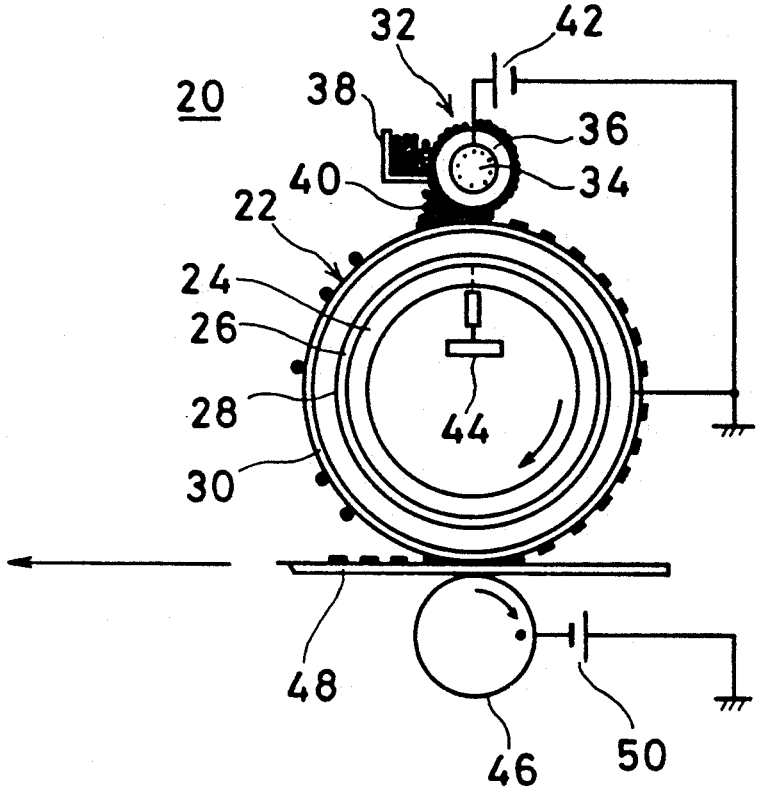
FIG. 3 is an illustrative view showing one example of an electrophotographing apparatus in accordance with the present invention.

FIG. 3 is an illustrative view showing one example of an electrophotographing apparatus in accordance with the present invention. With reference to FIG. 3, an electrophotographing apparatus 20 of this embodiment shown includes a photovoltaic photo-receptor (hereinafter simply called as "photo-receptor" often) 22, and the photo-receptor 22 includes a transparent substrate 24, a transparent electrode 26, a semiconductor photovoltaic layer 28 and a surface layer 30 as described later. The photo-receptor 22 is formed in a hollow cylindrical manner and supported by a shaft (not shown) to be rotated in a direction of an arrow mark A. A magnetic brush 32 is arranged above an outer surface of the photo-receptor 22. The magnetic brush 32 includes a magnetic roller 34 and an electric conductive sleeve 36 which covers an outer surface thereof and, when an electric conductive toner 40 is supplied from a toner box 38 to an outer surface of the electric conductive sleeve 36, the electric conductive toner is absorbed by a magnetic force of the magnetic roller 34 so that the toner 40 is held on the outer surface of the electric conductive sleeve 36. The magnetic roller 34 and the electric conductive sleeve 36, that is, the magnetic brush 32 is supported by a shaft (not shown) to be rotated in a direction of an arrow mark B. A developing bias 42 having a predetermined voltage value is applied to the electric conductive sleeve 36.

At a position opposite to the magnetic brush 32 by sandwiching the photo-receptor 22 therebetween, an LED array head 44 which is used for a light source for exposure is arranged inside the photo-receptor 22. As well known, the LED array head 44 includes a number of LED elements which are arranged in one or more lines to be extended in a direction of a width of the photo-receptor 22 and a driver which selectively drives the LED elements in accordance with image data as applied. In this embodiment shown, a center wavelength of the light emitted from the LED array head 44 is set as 6600Å and a density of the LED elements is set as 16 dots/mm. The light from the LED array head 44 is irradiated as a light image from an inside of the photo-receptor 22.

Furthermore, a transcribing roller 46 for transcribing a toner image which is formed on the surface of the photo-receptor 22 onto a paper 48 is arranged below the outer surface of the photo-receptor 22. In addition, the transcribing roller 46 is a solid cylindrical metallic roller to which a transcribing bias 50 having a proper voltage value is applied.

Figure 4:
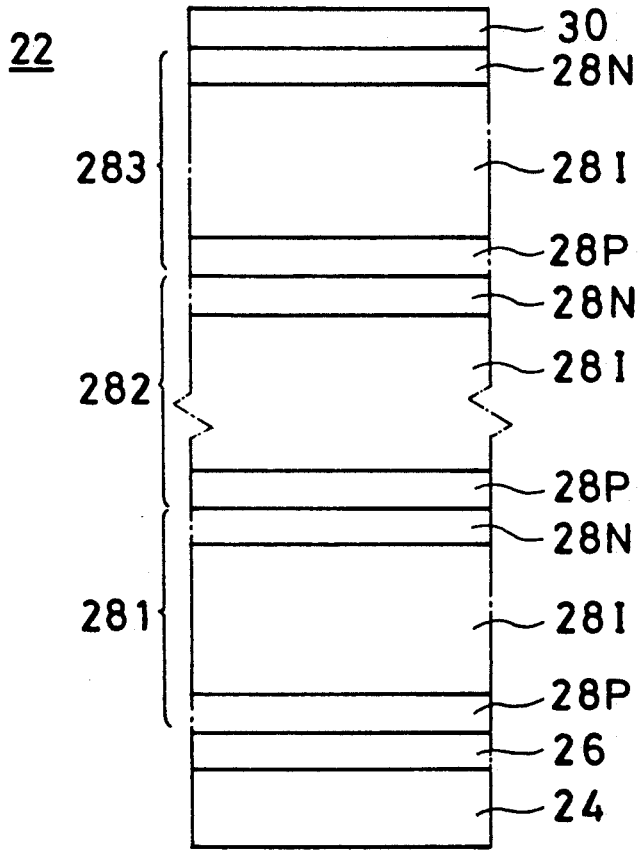
FIG. 4 is an illustrative sectional view showing one example of a photovoltaic photo-receptor of FIG. 3 embodiment.

With reference to FIG. 4, the photo-receptor 22 includes the transparent substrate 24 which is made of a glass, for example and formed in a hollow cylindrical form, and the transparent electrode 26 which includes a main component of a microcrystalline silicon and is laminated and formed on the transparent substrate 24. On the transparent electrode 26, a plurality of photovoltaic layers 281, 282 and 283 each including a main component of amorphous silicon (a-Si) are formed in a laminated fashion. Then, a surface layer 30 composed of an amorphous silicon nitride (a-SiN) or the like is laminated and formed on an outer surface of the outermost photovoltaic layer 283.

Now, the photovoltaic layers 281-283 will be described in more detail. Each of the photovoltaic layers 281–283 is constructed by an I-type layer 28I composed of a-Si of an I-type which generates a free carrier of an electron or a hole at a time of receiving a light, and a P-type layer 28P composed of a-Si of a P-type and an N-type layer 28N composed of a-Si of an N-type which are formed on both sides of the I-type layer 28I. Then, if the light from the LED array head 44 is irradiated into the respective photovoltaic layers 281–283 through the transparent substrate 24 and the transparent electrode 26, free carriers (electron and/or hole) are generated in the respective photovoltaic layers, which are collected by the transparent electrode 24 and the surface layer 30 so as to generate an electromotive force. Then, the electromotive force forms an electrostatic latent image in accordance with the light image from the LED array head 44, as described later.

In addition, in this embodiment shown, the optical energy band of the I-type layer 28I of the respective photovoltaic layers 281–283 are set to be gradually smaller from a side to which the light is irradiated toward a side of the surface layer 30. Specifically, the photovoltaic layers 281-283 are constructed in accordance with a next table I.

TABLE I

| | Composition | Optical energy bands Thickenss (Å) | (Eopt) |
|---|---|---|---|
| Transparent electrode | N-type μ -CSi | 10000 | 1.9 eV |
| Photovoltaic layer 281 | | | |
| P-type layer | P-type a-SiC | 200 | 2.0 |
| I-type layer | I-type a-Si | 1000 | 1.75 |

TABLE I-continued

| | Composition | Optical energy bands Thickness (Å) | (Eopt) |
|---|---|---|---|
| N-type layer | N-type a-Si | 100 | 1.7 |
| Photovoltaic layer 282 | | | |
| P-type layer | P-type a-Si | 200 | 1.65 |
| I-type layer | I-type a-Si | 1000 | 1.65 |
| N-type layer | N-type a-Si | 100 | 1.65 |
| Photovoltaic layer 283 | | | |
| P-type layer | P-type a-Si | 200 | 1.65 |
| I-type layer | I-type a-SiGe | 1000 | 1.5 |
| N-type layer | N-type a-Si | 100 | 1.65 |
| Surface layer 30 | a-SiN | 500 | 2.4 |

Figure 5:
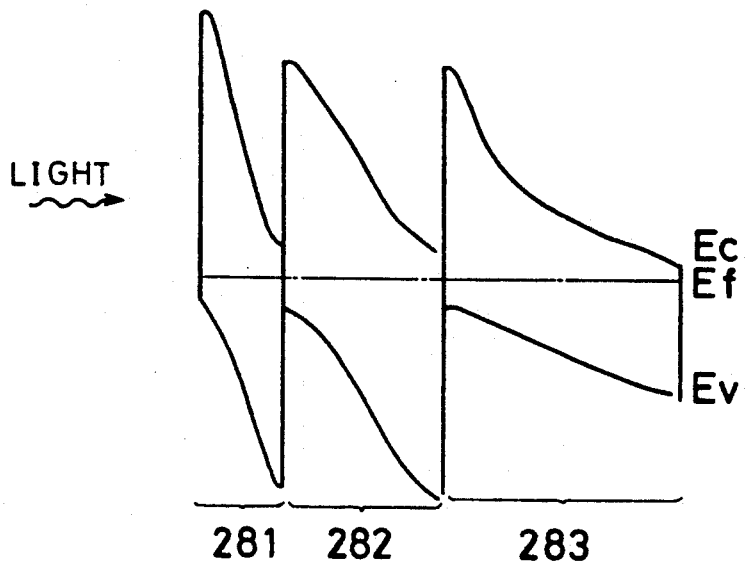
FIG. 5 is a graph showing optical energy bands in a photovoltaic photo-receptor shown in FIG. 4.

In the respective photovoltaic layers 281–283, a layer which mainly performs a photovoltaic function is the I-type layer 28I, and the optical energy bands Eopt of the I-type layers 28I are set to gradually become smaller from a side to which the light is irradiated toward a side of the surface layer 30, that is, from the photovoltaic layer 281 toward the photovoltaic layer 283 as shown in FIG. 5, as 1.75 eV, 1.65 eV and 1.5 eV, for example. Although the I-type layers 28I of the photovoltaic layers 281 and 282 are formed by a-Si, by slightly changing film forming condition, mainly the $H_2$ content and etc. are changed, and accordingly, it is possible to differ the optical energy bands Eopt from each other. In addition, the I-type layer 28I of the photovoltaic layer 283 is an alloy of Si and Ge, i.e. a-SiGe, and therefore, it is possible to make the same substantially smaller than that of other I-type layers.

Figure 6:
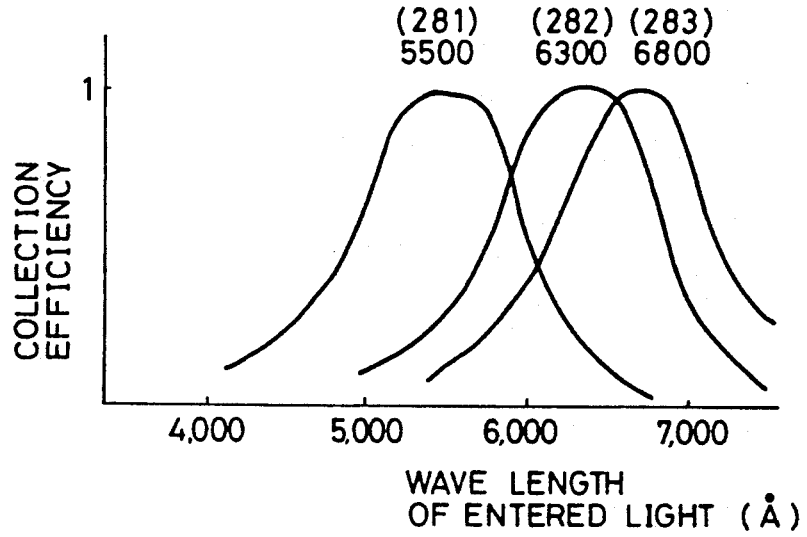
FIG. 6 is a graph showing a collection efficiency at a photovoltaic layer with respect to a wavelength of a light irradiated into a photovoltaic photo-receptor.

In the photovoltaic generation of electricity in a semiconductor, a wavelength of a light which contributes to the generation of electricity is dependent on the optical energy, band Eopt of a generating region. Therefore, in this embodiment shown, peaks of light collection efficiency in the respective photovoltaic layers 281, 282 and 283 are set as 5500Å, 6300Å and 6800Å, respectively as shown in FIG. 6. By thus setting the optical energy bands of the respective photovoltaic layers 281–283 so as to become gradually smaller from the side to which the light is irradiated, a light having a shorter wavelength is absorbed in a relatively shallow portion, i.e. at a side to which the light is irradiated and effectively contributes to the generation of electricity, and a light having a longer wavelength is not absorbed in the relative shallow portion and reaches a relatively deep portion, i.e. a side of the surface layer 30 and effectively contributes the generation of electricity. Therefore, a photovoltaic efficiency of the photo-receptor 22 becomes good as a whole.

A method for manufacturing such a photo-receptor 22 is as follows. More specifically, the transparent substrate 24 is put in a reaction chamber (not shown), and by producing a glow discharge after filling the reaction chamber with a suitable reaction gas, the transparent electrode 26 and the respective photovoltaic layers 281–283 can be sequentially formed in a laminated fashion. At this time, since the compositions of the respective photovoltaic layers are different from each other as shown in the above table I, the reaction gas is exchanged for each photovoltaic layer. In a next table II, which shows the respective photovoltaic layers and the reaction gasses used in growing the same, and the mixing ratios of impurity gasses with respect to silane $SiH_4$ that is the basic gas. In addition, $H_2$ is included as a carrier gas in the reaction gas, and a quantity thereof is changed in accordance with a purpose. Furthermore, a substrate temperature and an electric power may be changed for each layer.

TABLE II

| Mixing ratio of growing gases | | % |
|---|---|---|
| Transparent electrode 26 | $PH_3/SiH_4$ | 1 |
| Photovoltaic layer 281 | | |
| P-type layer 28P | $CH_4/SiH_4 + CH_4$ | 30 |
| | $B_2H_6/SiH_4 + CH_4$ | 0.1 |
| I-type layer 28I | $SiH_4$ | 100 |
| N-type layer 28N | $PH_3/SiH_4$ | 1 |
| Photovoltaic layer 282 | | |
| P-type layer 28P | $B_2H_6/SiH_4$ | 0.1 |
| I-type layer 28I | $SiH_4$ | 100 |
| N-type layer 28N | $PH_3/SiH_4$ | 1 |
| Photovoltaic layer 283 | | |
| P-type layer 28P | $B_2H_6/SiH_4$ | 0.1 |
| I-type layer 28I | $GeH_4/SiH_4 + GeH_4$ | 50 |
| N-type layer 28N | $PH_3/SiH_4$ | 1 |
| Surface layer 30 | $NH_3/SiH_4 + NH_3$ | 30 |

Next, an operation of the electrophotographing apparatus 20 (FIG. 3) which is constructed by utilizing the photo-receptor 22 being thus formed will be described. When the respective LED elements of the LED array head 44 are selectively driven in accordance with the image data or image signal from an inside of the photo-receptor 22, only a portion to which a light is irradiated from the LED array head 44 generates the photo-electromotive force on the photo-receptor 22, so that an electrostatic latent image having a surface voltage of approximately −2V with respect to transparent electrode 24 is formed on the surface layer 30 of the photo-receptor 22. At the substantially the same time, an electric conductive toner 40 is brought into contact with the photo-receptor 22 by the magnetic brush 32 from the side of the surface layer 30 while the same is applied with the developing bias 42 of approximately −0.5V, and therefore, the toner 40 is adhered to only a portion where the electric charge due to the surface potential exists, that is, only a portion of the electrostatic latent image, and thus, the electrostatic latent image is toner-developed.

Succeedingly, the photo-receptor 22 is rotated so that the toner image is transcribed onto the paper 48 which is led between the photo-receptor 22 and the transcribing roller 46 which is biased at approximately +100V. The paper 48 on which the toner image is transcribed is led to the fixing device (not shown), and thus, the transcribed toner image is fixed on the paper 48.

The photo-receptor 22 is further rotated and moved to the developing position of the magnetic brush 32, and the above described developing is performed again and thereafter, such a processing cycle is repeated.

Figure 1:
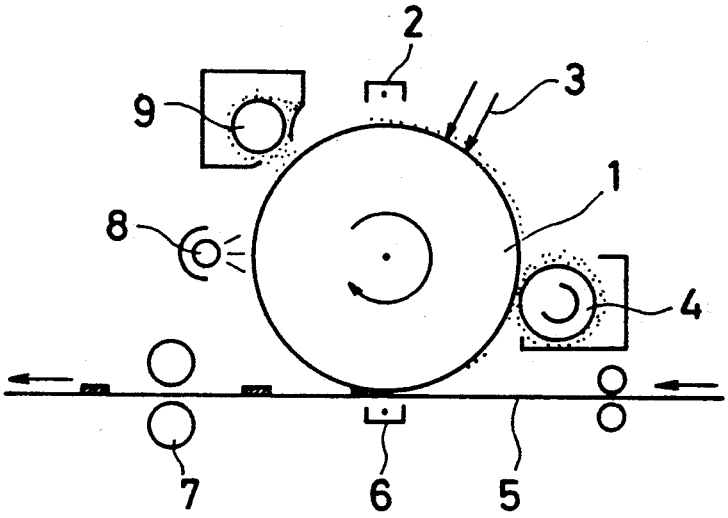
FIG. 1 PRIOR ART
FIG. 1 is an illustrative view showing one example of a conventional electrophotographing apparatus which utilizes a corona discharge.

In accordance with the experimentation by the inventor et al., a contrast of the image obtained by FIG. 3 embodiment was equal to a contrast of the image obtained by the electrophotographing apparatus which utilizes the corona discharge as shown in FIG. 1.

In addition, in this embodiment shown, the surface layer 30 may be omitted, but if the surface layer 30 is formed, the outer most surface of the photo-receptor 22 becomes stable and thus it is possible to obtain a high resolution.

Figure 7:
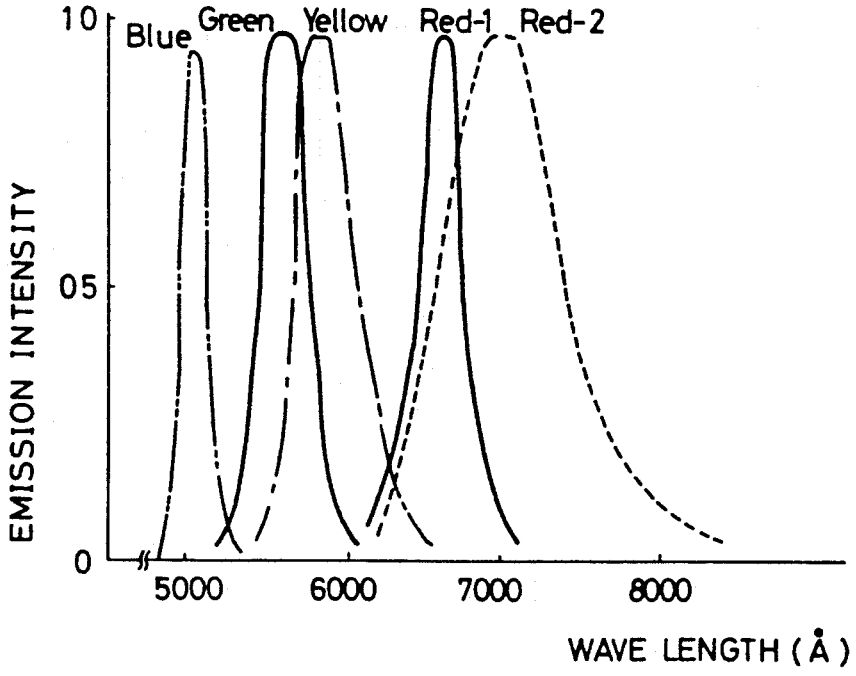
FIG. 7 is a graph showing an emission spectrum of an exposure light source, i.e. an LED array head.

FIG. 7 is a graph showing a wavelength profile of emission intensity of different LEDs. As well understood from FIG. 7, peak wavelength of blue, green, yellow, red-1 and red-2 are approximately 4500Å, 5500Å, 5900Å, 6600Å and 7000Å, respectively. Therefore, in the previous embodiment, the LED of the red-1 is utilized. Such an LED can be suitably selected in accordance with a light absorption characteristic of the photovoltaic layer. However, a proper combination of LEDs may be utilized. For example, when an LED array head in which blue, green and red-1 or red-2 are comb a composite light become white, and therefore, photovoltaic efficiencies at the respective photovoltaic layers may be further increased.

Figure 8:
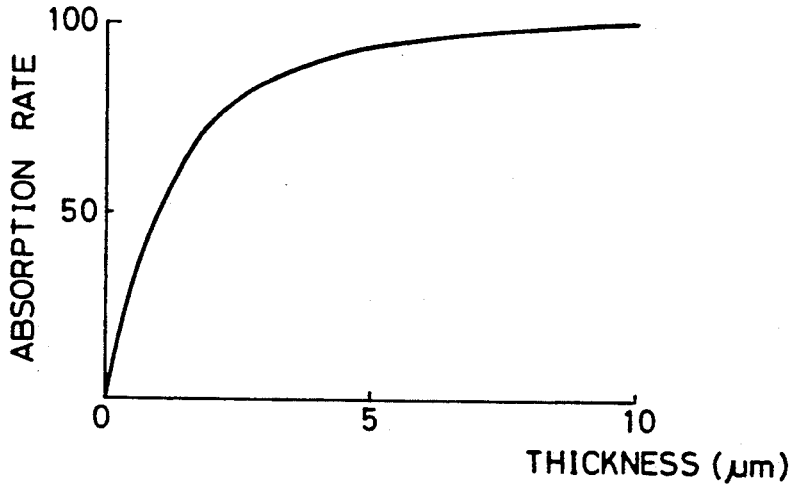
FIG. 8 is a graph showing a light absorption rate with respect to a thickness of an I-type layer of a photovoltaic layer.

FIG. 8 is a graph showing a light absorption rate of the red-1 (6600Å) of FIG. 7 with respect to a thickness of the I-type layer 28I (Eopt=1.65 eV) of the second photovoltaic layer 282. As well understood from FIG. 8, if the thickness of the I-type layer of the photovoltaic layer 282 is 1000Å, the light of the red-1 is absorbed approximately 10%.

Generally, in such a light absorption characteristic, in a case of the same optical energy band Eopt, the longer wavelength, the smaller absorption rate, and in a case of the same wavelength, the larger thickness, the larger absorption rate. Therefore, other than a method for changing of the optical energy bands Eopt of the respective photovoltaic layers as described above, the thickness of the respective photovoltaic layers may be changed.

Figure 9:
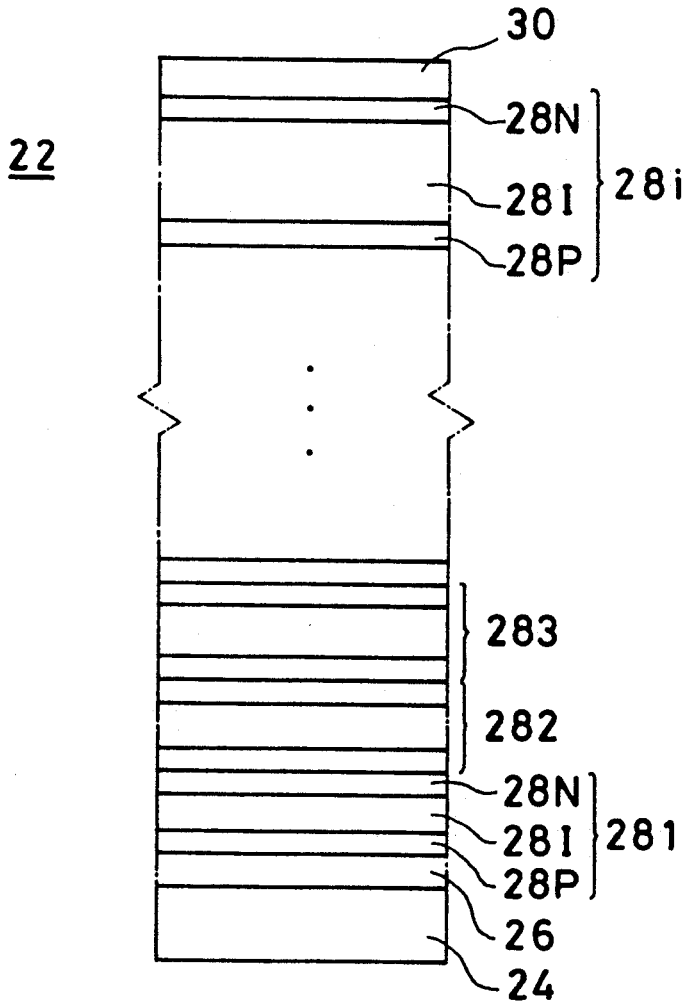
FIG. 9 is an illustrative sectional view showing a photovoltaic photo-receptor in accordance with another embodiment of the present invention.

FIG. 9 is an illustrative sectional view showing a photo-receptor of another embodiment in accordance with the present invention, in which the thickness of the respective photovoltaic layers are changed. With reference to FIG. 9, in a photo-receptor 44 of this embodiment shown, a plurality (i) of a-Si photovoltaic layers **281–28*i* are formed on the transparent electrode 26 which is formed on the transparent substrate 24 and formed by an ITO coated with $SnO_2$ thereon. Then, the optical energy band width Eopt of the I-type layers 28I of the respective photovoltaic layers 281-28*i* are set to be equal to the optical energy band of the I-type layer of the second photovoltaic layer 282 in FIG. 3** embodiment, i.e. 1.65 eV.

Generally, in a case where a plurality of photovoltaic layers each of which generates electricity when a light is irradiated is laminated and generated voltages from the respective photovoltaic layers are added to each other, it is necessary to approximate the photovoltaic currents from the respective photovoltaic layers to each other. The photovoltaic current is dependent on not only a light amount reaching the photovoltaic layer but also a thickness of the I-type layer. In other words, the larger thickness of the I-type layer, the larger photovoltaic current. On the assumption that an amount of the light irradiated into the I-type layer 28I of the photovoltaic layer 281 which is closest to the transparent substrate 24 is assumed as "100" and the photovoltaic layers of ten (10), for example, are formed, the light amount which is converted into the electricity at each of the photovoltaic layers is 10% ideally. In this embodiment shown, in order to realize such ideal values, the thickness of the I-type layers of the respective photovoltaic layers are set as 1000–10000Å as shown in a next table III. In the table III, a ratio (A) to be absorbed in each I-type layer and a light amount (B) which reaches each I-type layer on the assumption that an irradiated light amount from the LED array head 44 (FIG. 3) is "100" are shown and, at the same time, an absorption rate (A/B) at each I-type layer with respect to a light irradiated into each I-type layer for implementing the above described ratio (A) is shown.

TABLE III

| | Number of I-type layers | | | | | | | | | |
|---|---|---|---|---|---|---|---|---|---|---|
| | 1 | 2 | 3 | 4 | 5 | 6 | 7 | 8 | 9 | 10 |
| Thickness [Å] | 1000 | 1000 | 1200 | 1300 | 1500 | 1900 | 2200 | 2900 | 4000 | 7000 |
| A (%) | 10 | 9 | 9 | 9 | 9 | 9 | 9 | 9 | 9 | 9 |
| B (%) | 100 | 90 | 81 | 72 | 63 | 54 | 45 | 36 | 27 | 18 |
| A/B (%) | 10 | 10 | 11 | 12.5 | 14 | 17 | 20 | 25 | 33 | 50 |

All the respective photovoltaic layers 28 of the photo-receptor 22 in FIG. 9 embodiment are formed by a-Si and a film forming method thereof is similar to that of the previous embodiment. However, in order to change the thickness, a growing time of each film is suitably controlled. In addition, in FIG. 9 embodiment, a reaction gas having the composition shown in a next table IV is utilized. The table IV shows that the mixing ratios of impurity gases with respect to the silane $SiH_4$ which is used as the basic gas. In addition, a suitable amount of $H_2$ may be include as a carrier gas.

TABLE IV

| Mixing ratio of growing gases | | % |
|---|---|---|
| P-type layer 28P | $B_2H_6/SiH_4$ | 0.1 |
| I-type layer 28I | $SiH_4$ | 100 |
| N-type layer 28N | $PH_3/SiH_4$ | 1 |
| Surface layer 30 | $NH_3/SiH_4 + NH_3$ | 30 |

In the photo-receptor 22 of FIG. 9 embodiment, if the light from the LED array head 44 is irradiated into the respective photovoltaic layers **281–28*i* through the transparent substrate 24 and the transparent electrode 26, the free carriers of electrons or holes are generated within the I-type layer 28I of each photovoltaic layer, and the free carriers are collected by the transparent electrode 26 and the surface layer 30** to generate an electromotive force.

In addition, in FIG. 9 embodiment, in a case where the number of the photovoltaic layers is set as "10", an electrostatic latent image having a surface potential of approximately −6V was formed on the surface of the surface layer 30 of the photo-receptor 22 in accordance with the experimentation by the inventor et al. Therefore, the developing bias 42 is set at approximately −2V.

In the photo-receptor of FIG. 4 embodiment, three photovoltaic layers 281–283 each having different optical energy bands are laminated, but a voltage of electrostatic latent image formed on the surface layer 30 of the photo-receptor 22 is rather insufficient. Then, in an embodiment shown in FIG. 10, a plurality of (three layers in the embodiment) photovoltaic layers 28A, 28B, 28C having different optical energy bands are laminated. Then, as similar to FIG. 9 embodiment, in FIG. 10 embodiment, the thickness of the I-type layers of the respective photovoltaic layers are set so as to become longer from the transparent substrate 24 toward the surface layer 30, whereby it is intended to uniform the photovoltaic currents at the respective photovoltaic layers 28A–28C.

Figure 10:
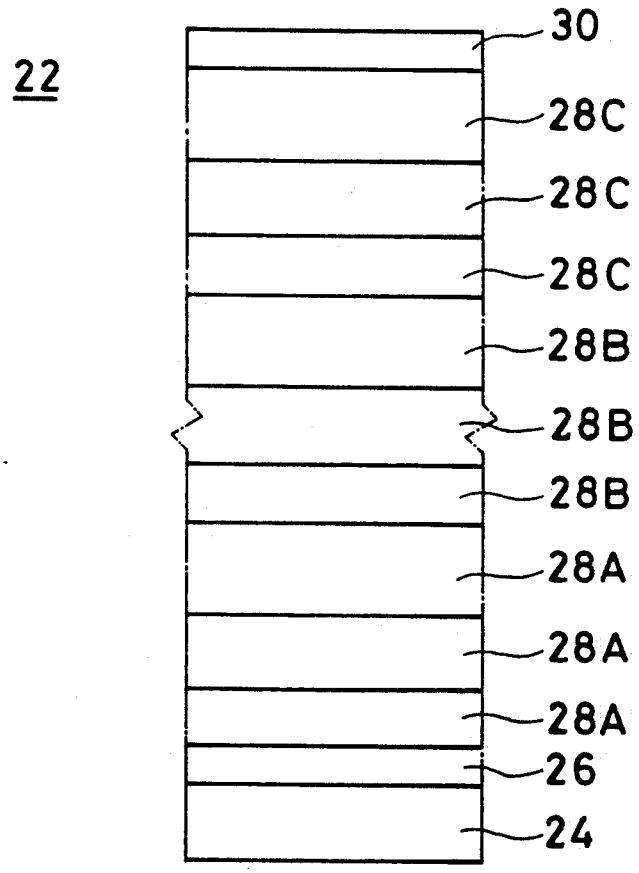
FIG. 10 is an illustrative sectional view showing a photovoltaic photo-receptor in accordance with another embodiment of the present invention.

By irradiating the light from the LED array head having a wavelength as shown in FIG. 7 onto the photoreceptor 22 of FIG. 10 embodiment, as similar to FIG. 9 embodiment, an electrostatic latent image of approximately −6V was obtained on the surface layer 30.

Figure 11:
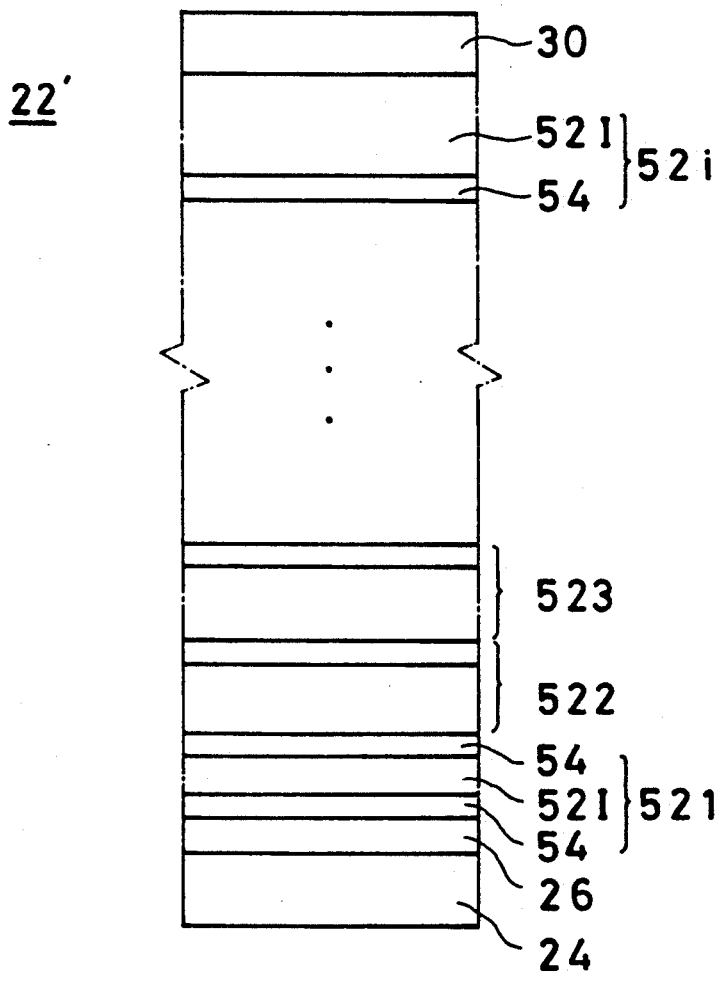
FIG. 11 is an illustrative sectional view showing a photovoltaic photo-receptor in accordance with a further embodiment of the present invention.

FIG. 11 is an illustrative sectional view showing another embodiment of a photo-receptor in accordance with the present invention. In the above described embodiments, an a-Si photovoltaic layer having a PIN junction is used as a photo-receptor, in contrast, a photo-receptor 22' of this embodiment shown includes a plurality of (i) photovoltaic layers **521–52*i* which are laminated on the transparent electrode 24. Each of the respective photovoltaic layers 521–52*i* includes an I-type layer 52I composed of a-Si and insulation layers 54 which are laminated at both sides thereof and composed of a-SiN. Then, in this embodiment shown, an impurity element which determines an conductive type (for example, boron in a case of a P-type or phosphorus in a case of an N-type) is doped in the I-type layer 52I. Such a dopant is doped in accordance with a density profile such that a density becomes larger toward the surface layer 30**.

Figure 12:
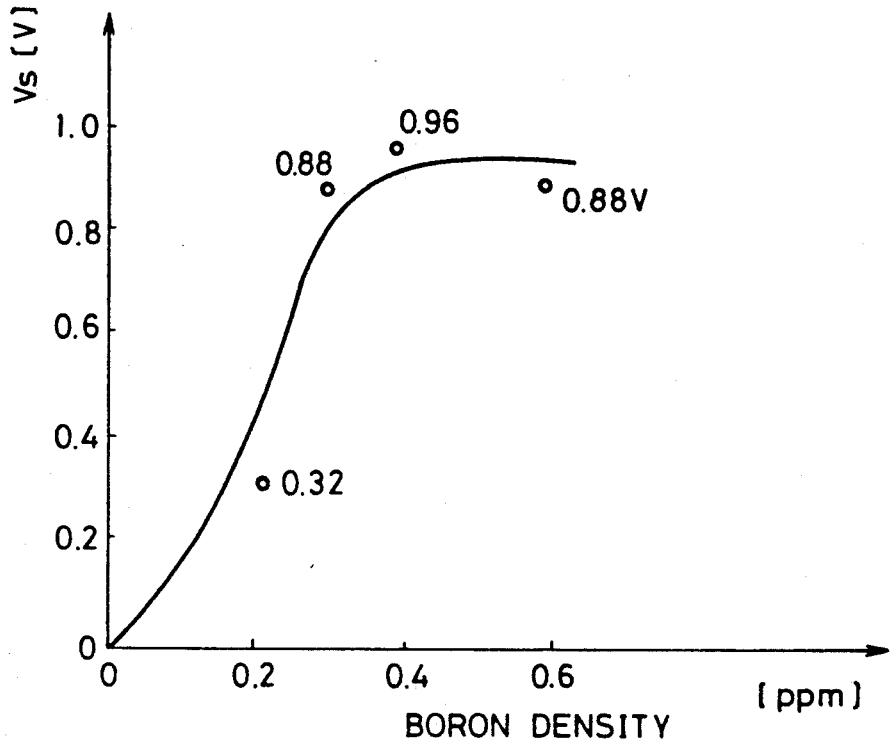
FIG. 12 is a graph showing a photo-electromotive force with respect to an impurity density in an I-type layer of a photovoltaic photo-receptor shown in FIG. 11.

More specifically, as well understood from FIG. 12 which shows a relationship between a boron density of the I-type layer and a generated voltage, up to 0.4 ppm of the boron density, the voltage becomes large in approximately proportion to the increase of the density. Then, a density profile is such that the density is linearly increased from 0 ppm to 0.4 ppm from a side of the insulation layer 54 toward the side of the surface layer 30, whereby the boron density of the I-type layer 52I at the side of the surface layer 30 of each of the respective photovoltaic layers **521–52*i*** becomes approximately 0.4 ppm.

In addition, each insulation layer 54 of the photovoltaic layers **521–52*i* is set as the thickness of such a degree that a tunnel phenomenon occurs, specifically, 10–100Å. By the tunnel phenomenon of the insulation layer 54, the photovoltaic currents from the respective photovoltaic layers can be collected by the surface layer 30 through the insulation layers 54**.

Figure 13:
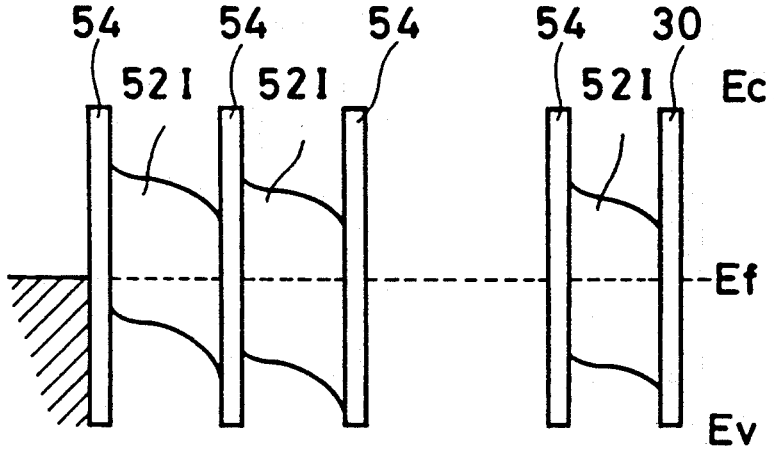
FIG. 13 is a graph showing optical energy bands in a photovoltaic photo-receptor shown in FIG. 11.

In the photo-receptor 22' of FIG. 11 embodiment, optical energy bands as shown in FIG. 13 are formed. More specifically, the optical energy bands having internal electric fields in accordance with the density profile of the dopant are formed in the respective photovoltaic layers **521–52*i*, and the photo-carriers are moved due to a drift of the internal electric fields, whereby the photovoltaic generation of electricity is performed at each of the respective photovoltaic layers 521–52*i***.

In this embodiment shown, on the assumption that an amount of the light irradiated into the I-type layer 52I of the photovoltaic layer 521 which is closest to the transparent substrate 24 is assumed as "100" and the photovoltaic layers of seven (7), for example, are formed, the light amount which is converted into the electricity at each of the photovoltaic layers is 14% ideally. In this embodiment shown, in order to realize such ideal values, the thickness of the I-type layers of the respective photovoltaic layers are set as 1500–8000Å as shown in a next table V. In the table V, a ratio (A) to be absorbed in each I-type layer and a light amount (B) which reaches each I-type layer on the assumption that an irradiated light amount from the LED array head 44 (FIG. 3) is "100" are shown and, at the same time, and an absorption rate (A/B) at each I-type layer with respect to the irradiated light into each I-type layer for implementing the above described ratio (A) is shown.

TABLE V

| | Number of I-type layers | | | | | | |
|---|---|---|---|---|---|---|---|
| | 1 | 2 | 3 | 4 | 5 | 6 | 7 |
| Thickness [Å] | 1500 | 1700 | 2000 | 2500 | 3000 | 4300 | 8000 |
| A (%) | 14 | 14 | 13 | 13 | 12 | 12 | 12 |
| B (%) | 100 | 86 | 72 | 59 | 46 | 34 | 22 |
| A/B (%) | 14 | 16 | 18 | 22 | 26 | 35 | 55 |

All the respective photovoltaic layers **521–52*i* of the photo-receptor 22' of FIG. 11 embodiment are formed by an amorphous semiconductor (a-SiN and a-Si), but a film forming method thereof is similar to that of the previous embodiments. However, in order to change the thickness, a growing time of each film is suitably controlled. In addition, in FIG. 11** embodiment, a reaction gas having the composition shown in a next table VI is utilized. The table VI shows the mixing ratios of impurity gases with respect to silane $SiH_4$ which is used as the basic gas.

TABLE VI

| Mixing ratio of growing gases | | % |
|---|---|---|
| Transparent electrode 26 | $PH_3/SiH_4$ | 1 |
| Insulation layer 54 | $NH_3/SiH_4 + NH_3$ | 35 |
| I-type layer 521 | $B_2H_6/SiH_4$ | 0–0.4 ppm (linearly graded) |
| Surface layer 30 | $NH_3/SiH_4 + NH_3$ | 30 |

In the photo-receptor 22' of FIG. 11 embodiment, if a light from the LED array head 44 is irradiated into the respective photovoltaic layers **521–52*i* through the transparent substrate 24 and the transparent electrode 26, free carriers of electrons or holes are generated in the I-type layer 52I of each photovoltaic layer, and the free carriers are collected by the transparent electrode 26 and the surface layer 30** to generate the electromotive force.

In addition, in FIG. 11 embodiment, in a case where the number of the photovoltaic layers is set as "7", an electrostatic latent image having a surface potential of approximately −4V was formed on the surface of the surface layer 30 of the photo-receptor 22' in accordance with the experimentation by the inventor et al. Therefore, the developing bias 42 is set at approximately −1.5V. Then, in accordance with this embodiment shown, it is possible to make the surface resistance of the photovoltaic layer high, and therefore, it is possible to easily make a resolution high.

Figure 14:
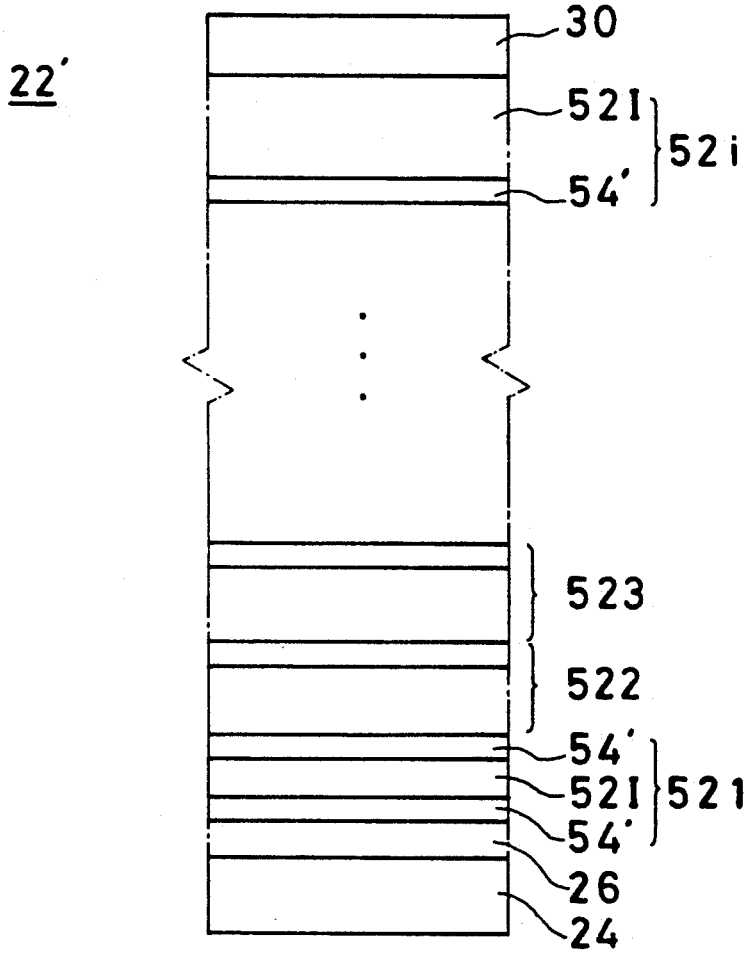
FIG. 14 is an illustrative sectional view showing a photovoltaic photo-receptor in accordance with the other embodiment of the present invention.

FIG. 14 shows a photo-receptor 22' of another embodiment in accordance with the present invention. In this embodiment which is a modification of FIG. 11 embodiment, no dopant is doped in the I-type layer 52I constituting the respective photovoltaic layers **521–52*i* and an impurity such as N, C, O or the like is added to each insulation layer 54'. Then, a density profile of the impurity is set such that the density is linearly increased in the range of 0–80% from the transparent substrate 24 toward the surface layer 30. In addition, the thickness of each I-type layer is set similar to that of the photo-receptor 22' of FIG. 11** embodiment.

Figure 15:
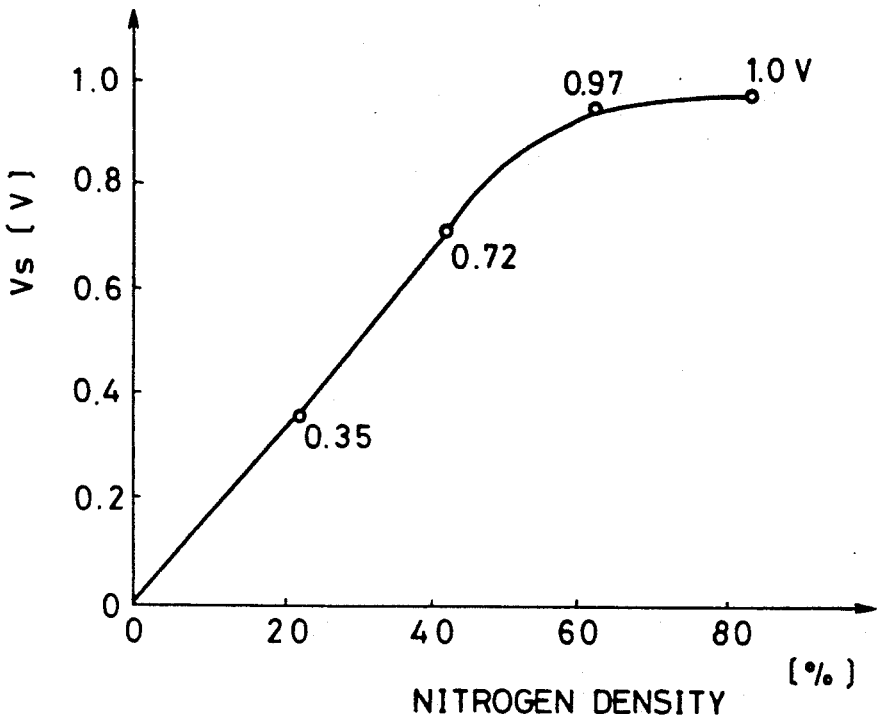
FIG. 15 is a graph showing a potential of an electrostatic latent image with respect to an impurity density in an insulation layer of a photovoltaic photoreceptor shown in FIG. 14.

If the impurity such as N, C, $O_2$ or the like is thus added in the insulation layer 54' in accordance with a predetermined density profile, as shown in FIG. 15, a photovoltaic electromotive force in accordance with the density is generated in the I-type 52I which is adjacent thereto. In FIG. 15, a relationship between a doped amount of N being doped in the insulation layer 54' of a-SiN and an electromotive force.

Figure 16:
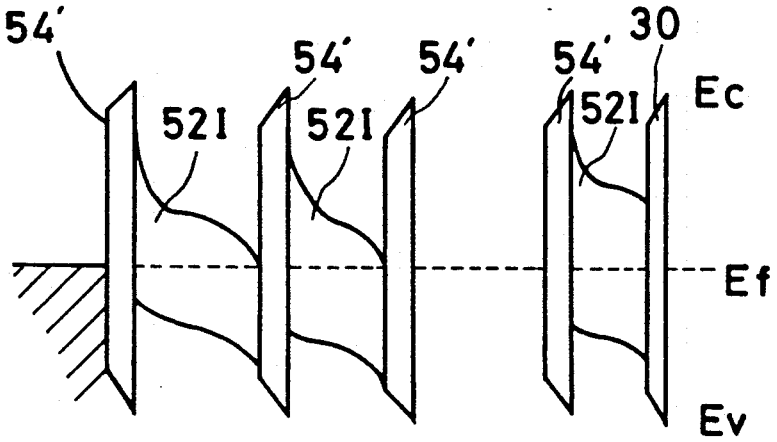
FIG. 16 is a graph showing optical energy bands in a photovoltaic photo-receptor shown in FIG. 14.

In the photo-receptor 22' of FIG. 14 embodiment, energy bands as shown in FIG. 16 are formed. Then, in this embodiment shown, an electrostatic latent image having a potential of approximately −4V is formed on the surface layer 30 of the photo-receptor 22'.

In addition, the composition of a reaction gas in manufacturing the photo-receptor 22' of FIG. 14 embodiment is shown in a next table VII. The table VII shows the mixing ratio of the impurity gases with respect to silane $SiH_4$ which is used as the basic gas.

TABLE VII

| Mixing ratio of growing gases | | % |
|---|---|---|
| Transparent electrode 26 | $PH_3/SiH_4$ | 1 |
| Insulation layer 54 | $NH_3/SiH_4 + NH_3$ | 0–80 (linearly graded) |
| I-type layer 52I | $SiH_4$ | 100 |
| Surface layer 30 | $NH_3/SiH_4 + NH_3$ | 50 |

As the I-type layer of the photovoltaic layer of the photovoltaic photo-receptor 22' shown in FIG. 11 or FIG. 14, an amorphous semiconductor such as a-SiC, a-SiGe, and etc. may be utilized other than a-Si of the embodiments.

In addition, in a case where a PIN junction is formed in the photovoltaic layer in reverse to the above described embodiments, N-type layer, I-type layer and P-type layer may be laminated in this order from a side to which an exposure light is irradiated.

Furthermore, in the photovoltaic layer of the photovoltaic photo-receptor of the present invention, other than the amorphous semiconductor, GaAs (heterojunction or homojunction), ITO/InP, CdS/CdTe, glass/ITO/Te/Se/Pt, glass/$SnO_2$/CdSe/Se/Au and so on may be utilized.

In addition, in the above described embodiments, as the light source means, the LED array head 44 is utilized. However, a combination of a fluorescent lamp and a liquid crystal shutter may be utilized as such a light source for exposure. In this case, the fluorescent lamp has a light emission profile of a wider width differently from the LED, and therefore, the light can be absorbed in the respective photovoltaic layers and thus the generation of electricity can be made effectively.

In addition, in any of the embodiments, an electric conductive toner is used. However, an insulative toner may be utilized. In the prior art shown in FIG. 2, by applying the developing bias to the surface of the photo-receptor through the electric conductive toner, the photo-receptor is charged. Therefore, it is necessary to use the electric conductive toner. In contrast, since the photo-receptor in accordance with the present invention establishes a potential necessary for an electrostatic latent image by the photo-electromotive force which is generated in itself, it is not necessary to charge the photo-receptor by utilizing the developing bias. Therefore, in accordance with the present invention, not only the electric conductive toner but also the insulative toner can be utilized. However, it may be necessary to set a value of the developing bias 42 sufficiently large in a case where the insulative toner is utilized.

Figure 2:
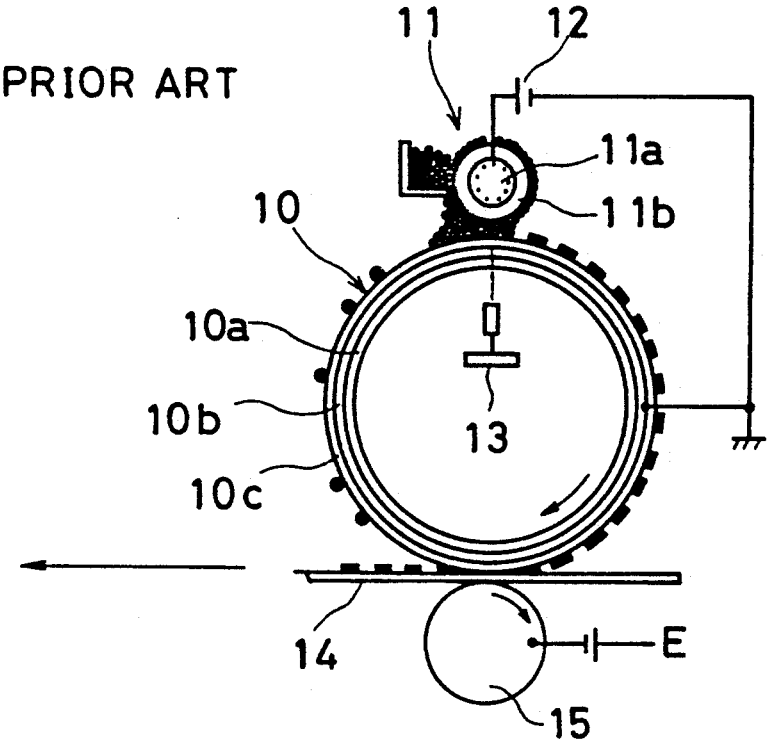
FIG. 2 PRIOR ART
FIG. 2 is an illustrative view showing one example of a conventional electrophotographing apparatus which does not utilize a corona discharge.

Furthermore, it is necessary to arrange the magnetic brush and the light source for exposure at the substantially the same position in order to charge the photo-receptor prior to the exposure in FIG. 2 prior art; however, in the electrophotographing apparatus in accordance with the present invention, since the charge and the formation of the electrostatic latent image are simultaneously performed by the exposure, it is not necessary to arrange these components at the same position. Therefore, in the above described embodiments, the magnetic brush 32 and the light source for exposure, i.e. the LED array head 44 are arranged at the same position so as to opposite the photo-receptor 22 by sandwiching therebetween; however, the light source for exposure may be arranged at an upstream side in a rotation direction of the photo-receptor 22 from the magnetic brush 32.

In addition, in the above described embodiments, the light source for exposure, i.e. the LED array head 44 is arranged in a hollow portion of the photo-receptor 22 so that the light from the light source for exposure is irradiated from the side of the transparent substrate 24 of the photo-receptor. However, the light may be irradiated from the side of the surface layer 30 of the photo-receptor 22. In this case, an opaque substrate may be utilized rather than the transparent substrate.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A photovoltaic photo-receptor, comprising:

a substrate; and photovoltaic means for forming an electrostatic latent image, said photovoltaic means including a plurality of semiconductor photovoltaic layers laminated on said substrate and each containing a semiconductor junction which generates a respective photo-electromotive force voltage as a light image is being irradiated thereto, each of said respective photo-electromotive force voltages being added to each other such that an accumulated voltage forms said electrostatic latent image on said photovoltaic means.

2. A photovoltaic photo-receptor in accordance with claim 1, wherein said substrate includes a transparent substrate through which said light image may be irradiated onto said semiconductor photovoltaic layers.

3. A photovoltaic photo-receptor in accordance with claim 1 further comprising a surface layer formed on an upper most semiconductor photovoltaic layers.

4. A photovoltaic photo-receptor in accordance with claim 1, wherein light absorption rates of the photovoltaic layers vary so as to become gradually larger from a side to which a light is irradiated.

5. A photovoltaic photo-receptor in accordance with claim 4, wherein optical energy bands of the respective semiconductor photovoltaic layers vary from each other.

6. A photovoltaic photo-receptor in accordance with claim 4, wherein thickness of the respective semiconductor photovoltaic layers vary from each other.

7. A photovoltaic photo-receptor in accordance with claim 1, wherein optical energy bands of the respective semiconductor photovoltaic layers are changed.

8. A photovoltaic photo-receptor, comprising:

a substrate; and photovoltaic means for forming an electrostatic latent image, said photovoltaic means including a plurality of photovoltaic layers which are laminated on said substrate and each of which is composed of an amorphous semiconductor having a semiconductor junction which generates a respective photo-electromotive force voltage as a light image is being irradiated thereto, each of said respective photo-electromotive force voltages being added to each other such that an accumulated voltage forms said electrostatic latent image on said photovoltaic means.

9. A photovoltaic photo-receptor in accordance with claim 8, wherein said substrate includes a transparent substrate through which said light image may be irradiated onto said semiconductor photovoltaic layer.

10. A photovoltaic photo-receptor in accordance with claim 8, further comprising a surface layer formed on an upper most one of the semiconductor photovoltaic layers.

11. A photovoltaic photo-receptor in accordance with claim 8, wherein light absorption rates of the photovoltaic layers vary so as to become gradually larger from a side to which a light is irradiated.

12. A photovoltaic photo-receptor in accordance with claim 11, wherein optical energy bands of the respective semiconductor photovoltaic layers from each other.

13. A photovoltaic photo-receptor in accordance with claim 12, wherein thickness of the respective semiconductor photovoltaic layers vary from each other.

14. A photovoltaic photo-receptor in accordance with claim 13, wherein optical energy bands of the respective semiconductor photovoltaic layers vary from each other.

15. A photovoltaic photo-receptor in accordance with claim 8, wherein said photovoltaic layer includes a PIN junction.

16. A photovoltaic photo-receptor in accordance with claim 8, wherein said photovoltaic layer includes a junction of a semiconductor layer and an insulation layer.

17. An electrophotographing apparatus, comprising:

a photovoltaic photo-receptor which includes a substrate and photovoltaic means which comprises a plurality of semiconductor junctions laminated on said substrate, said semiconductor junctions being responsive to irradiation of a light image for generating a respective photo-electromotive force voltage;

light source means for irradiating said light image onto said photovoltaic photo-receptor, thereby forming on a surface of said photovoltaic photo-receptor an electrostatic latent image with a voltage which is obtained by adding each of said respective photo-electromotive force voltages to each other;

toner supplying means for toner-developing said electrostatic latent image to form a toner image by bringing a toner into contact with a surface of said photovoltaic photoreceptor; and transcribing means for transcribing the toner image onto a paper.

18. An electrophotographing apparatus in accordance with claim 17, wherein said substrate of said photovoltaic photo-receptor includes a transparent substrate, and said light source means arranged at a side of said transparent substrate of said photovoltaic photoreceptor, whereby the light image from said light source means is irradiated onto said photovoltaic layer through said transparent substrate.

19. An electrophotographing apparatus in accordance with claim 18, wherein said photovoltaic photo-receptor includes a transparent electrode formed on said transparent substrate.

20. An electrophotographing apparatus in accordance with claim 17, wherein said photovoltaic photo-receptor further includes a surface layer formed on an upper most one of the photovoltaic layers.

21. A photovoltaic photo-receptor in accordance with claim 17, wherein light absorption rates of the photovoltaic layers vary so as to become gradually larger from a side to which a light is irradiated.

22. A photovoltaic photo-receptor in accordance with claim 21, wherein optical energy bands of the respective semiconductor photovoltaic layers vary from each other.

23. A photovoltaic photo-receptor in accordance with claim 21, wherein thicknesses of the respective semiconductor photovoltaic layers vary from each other.

24. A photovoltaic photo-receptor in accordance with claim 23, wherein optical energy bands of the respective semiconductor photovoltaic layers are changed.

25. An electrophotographing apparatus in accordance with claim 17, wherein said light source means includes an LED array head which emits a light having a predetermined wavelength.

26. An electrophotographing apparatus in accordance with claim 25, wherein said LED array head is constructed so as to simultaneously emit a plurality of kinds of light having different wavelength.

27. An electrophotographing apparatus in accordance with claim 17, wherein said light source means has a light emission wavelength profile being relatively wide.

28. An electrophotographing apparatus in accordance with claim 17, wherein said toner supplying means supplies an electric conductive toner.

29. An electrophotographing apparatus in accordance with claim 17, wherein said toner supplying means supplies an insulative toner.

30. An electrophotographing apparatus, comprising:

a photovoltaic photo-receptor which includes a transparent substrate, a transparent electrode formed on said transparent substrate, a plurality of photovoltaic layers which are sequentially laminated and formed on said transparent electrode and which are each composed of an amorphous semiconductor having a respective photovoltaic function, and a surface layer formed on said photovoltaic layer so as to be an uppermost layer, said photovoltaic layers being responsive to irradiation of a light image onto the surface for generating photovoltaic voltages in accordance with said respective photovoltaic functions, whereby an electrostatic latent image of a potential which is established by adding said voltages generated at said photovoltaic layers is formed on said surface layer, said photovoltaic layers being formed to be gradually thickened from a lower most layer to said uppermost layer such that said light image cannot be absorbed by lower layers;

light source means disposed below said transparent substrate for irradiating said light image onto said plurality of photovoltaic layers through said transparent substrate and said transparent electrode;

toner supplying means for toner-developing said electrostatic latent image into a toner image by bringing a toner into contact with the surface of said photovoltaic photo-receptor; and

31. An electrophotographing apparatus in accordance with claim 17, further comprising developing bias applying means for applying a developing bias to said toner supplying means independently from said accumulated voltage for said electrostatic latent image.

32. An electrophotographing apparatus in accordance with claim 21, further comprising developing bias applying means for applying a developing bias to said toner supplying means independently from said accumulated voltage for said electrostatic latent image.

33. An electrophotographing apparatus in accordance with claim 30, further comprising developing bias applying means for applying a developing bias to said toner supplying means independently from said accumulated voltage for said electrostatic latent image.

* * * * *